US007658630B2

(12) United States Patent
Tipley et al.

(10) Patent No.: US 7,658,630 B2
(45) Date of Patent: Feb. 9, 2010

(54) SYSTEM AND METHOD FOR CONNECTING ELECTRONIC COMPONENTS

(75) Inventors: Roger E. Tipley, Houston, TX (US); Arthur G. Volkmann, Spring, TX (US); Barry S. Basile, Houston, TX (US); Steve L. Radabaugh, Tomball, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 969 days.

(21) Appl. No.: 11/108,338

(22) Filed: Apr. 18, 2005

(65) Prior Publication Data

US 2006/0234540 A1 Oct. 19, 2006

(51) Int. Cl.
*H01R 13/15* (2006.01)
*H01R 13/62* (2006.01)

(52) U.S. Cl. ..... 439/260; 439/342

(58) Field of Classification Search ..... 439/260, 439/377, 342, 326, 327, 341, 376, 633, 67; 361/786, 759, 801, 802
See application file for complete search history.

(56) References Cited

U.S. PATENT DOCUMENTS

| | | | | |
|---|---|---|---|---|
| 4,370,012 | A * | 1/1983 | Grabbe et al. | 439/260 |
| 4,403,819 | A | 9/1983 | Weber | |
| 4,509,810 | A | 4/1985 | Erlam et al. | |
| 4,579,411 | A | 4/1986 | Cobaugh et al. | |
| 4,636,021 | A | 1/1987 | Bobb et al. | |
| 4,648,668 | A | 3/1987 | Sinisi | |
| 4,919,626 | A | 4/1990 | Anhalt et al. | |
| 5,308,257 | A | 5/1994 | Buchter et al. | |
| 5,374,198 | A | 12/1994 | Nagata | |
| 5,769,668 | A * | 6/1998 | Tondreault | 439/633 |
| 5,785,549 | A * | 7/1998 | Takayasu | 439/67 |
| 5,797,762 | A | 8/1998 | Saito et al. | |
| 6,080,000 | A | 6/2000 | Baker et al. | |
| 6,185,104 | B1 * | 2/2001 | Obermaier | 439/260 |
| 6,527,573 | B2 | 3/2003 | Stein, Sr. et al. | |
| 6,554,627 | B1 | 4/2003 | Chen | |
| 6,667,890 | B1 | 12/2003 | Barringer et al. | |
| 6,860,747 | B2 | 3/2005 | Nguyen | |
| 2003/0024721 | A1 | 2/2003 | Gustine et al. | |
| 2003/0109178 | A1 | 6/2003 | Ohashi | |
| 2003/0148646 | A1 | 8/2003 | Frantum, Jr. et al. | |
| 2004/0043664 | A1 | 3/2004 | Sato et al. | |

FOREIGN PATENT DOCUMENTS

| | | |
|---|---|---|
| EP | 0251508 | 1/1988 |
| EP | 0473418 B1 | 10/1997 |
| WO | WO2004032289 | 4/2004 |
| WO | WO2004047228 | 6/2004 |

OTHER PUBLICATIONS

"Joint." The American Heritage® Dictionary of the English Language, Fourth Edition. Houghton Mifflin Company, 2004. <Dictionary.com http://dictionary.reference.com/browse/joint>.*

* cited by examiner

*Primary Examiner*—Felix O Figueroa

(57) ABSTRACT

A system and method for connecting electrical components. More specifically, a method includes positioning a first set of electrical contacts of a first device opposite from a second set of electrical contacts of a second device, and activating a mechanism configured to rotate the first set of electrical contacts between an engaged position against the second set of electrical contacts and a disengaged position offset from the second set of electrical contacts.

21 Claims, 4 Drawing Sheets

FIG. 4
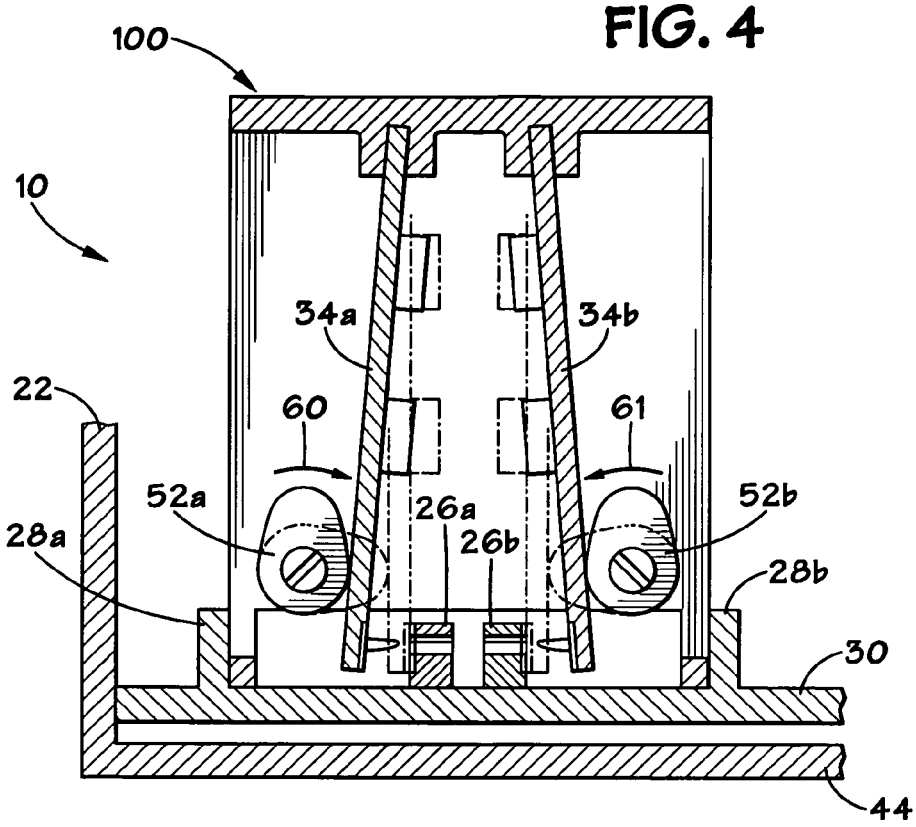
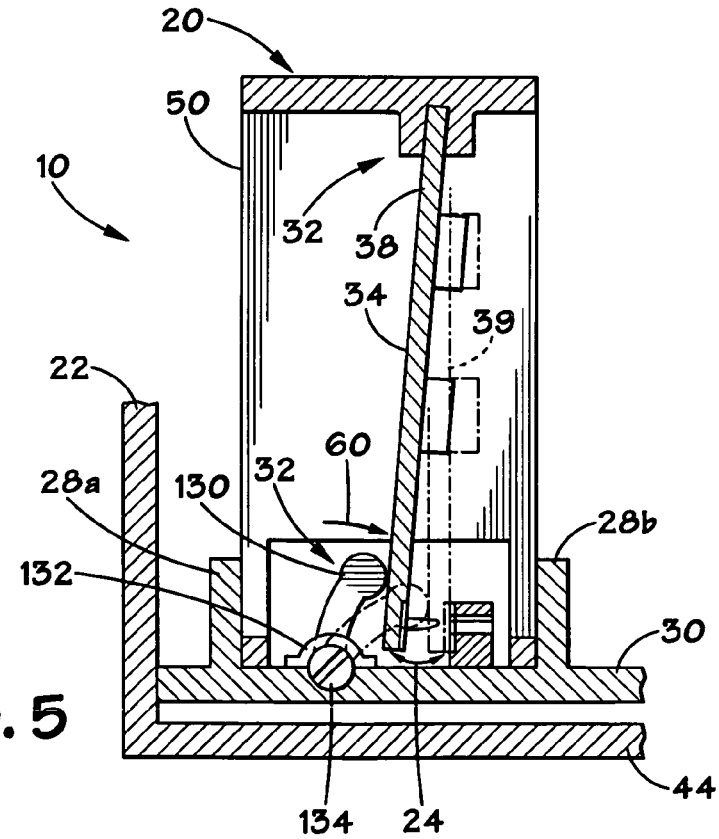
FIG. 5

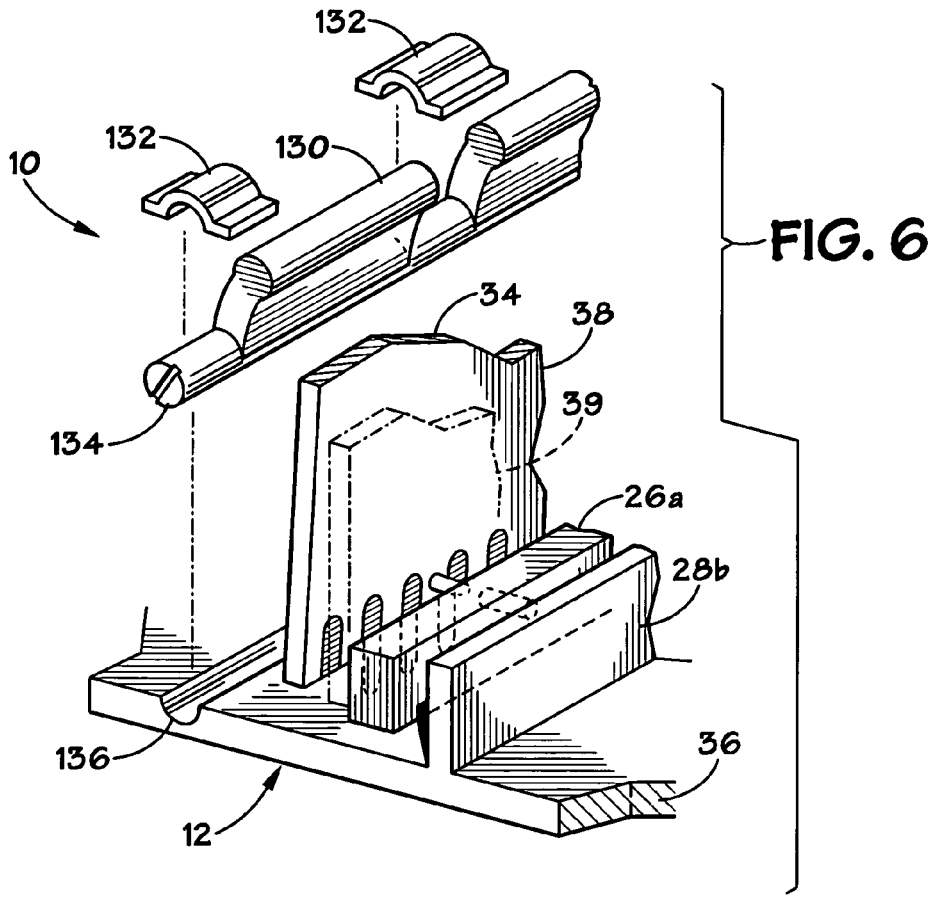
FIG. 6
FIG. 7
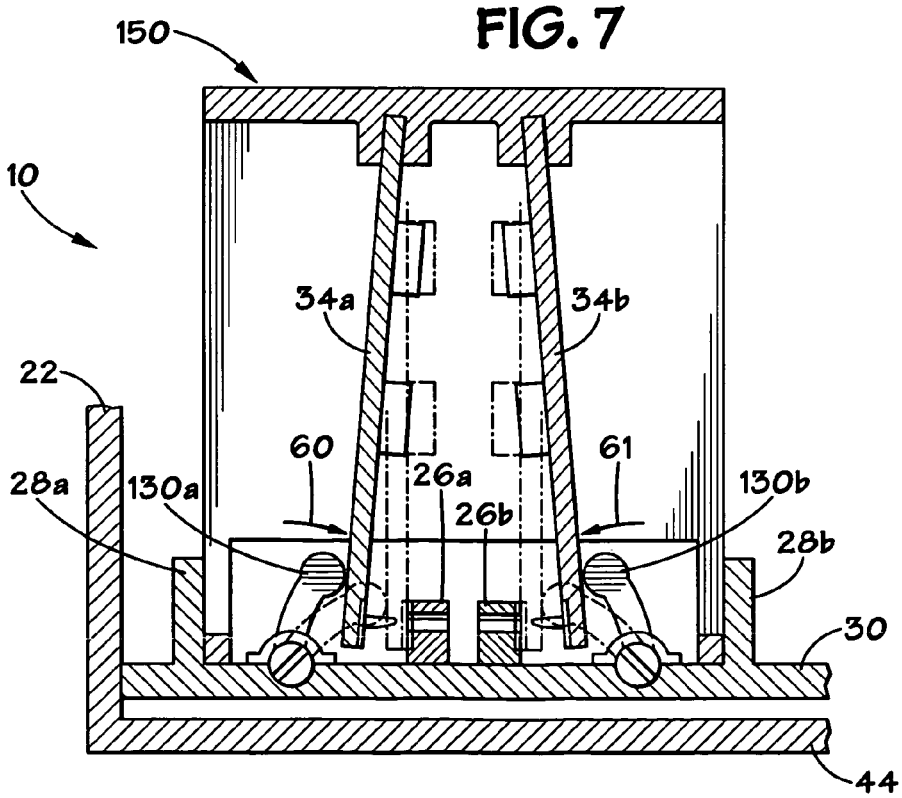

SYSTEM AND METHOD FOR CONNECTING ELECTRONIC COMPONENTS

BACKGROUND OF THE RELATED ART

In certain computers and electronic systems, a primary chassis or enclosure may house a plurality of removable blades that provide different functionality for the system as a whole. A blade comprises a circuit board having a variety of computer components, such as a processor, memory, or storage, which is typically mounted in a secondary chassis or enclosure that can be slid into and out of the primary chassis. For example, different types of blades may include computing blades, which may include a processor and related memory and storage, dedicated memory blades, or dedicated storage blades. Conventional blades connect to the primary chassis with a high density connector (i.e., a relatively small connector with many pins) mounted on the back end of the blade enclosure. This high density connector is configured to mate with another high density connecter mounted on a backplane within the primary chassis. These high density connectors may be relatively high in price. Further, because the backplane is usually positioned at the back end of the primary chassis, all of the blade enclosures used within the primary chassis are typically the same length as the primary chassis to permit the two high density connectors to mate. This size restriction may increase the cost of the blade if the blade could otherwise have been shorter in length. Lastly, because the backplane may block an entire backend of the primary chassis, the backplane can restrict the flow of air through the primary chassis, which may increase the ambient temperature inside the system.

BRIEF DESCRIPTION OF THE DRAWINGS

Advantages of one or more disclosed embodiments may become apparent upon reading the following detailed description and upon reference to the drawings in which:

FIG. 4 is a diagram illustrating a partial cross-sectional view of alternative computer system comprising the connection system in accordance with embodiments of the present invention;

FIG. 5 is a diagram illustrating a partial cross-sectional view of another alternative computer system comprising the connection system in accordance with embodiments of the present invention;

FIG. 6 is a diagram illustrating a exploded perspective view of the alternative computer system of FIG. 5 in accordance with embodiments of the present invention; and FIG. 7 is a diagram illustrating a partial cross-sectional view of yet another alternative computer system comprising the connection system in accordance with embodiments of the present invention.

DETAILED DESCRIPTION

One or more specific embodiments of the present invention will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
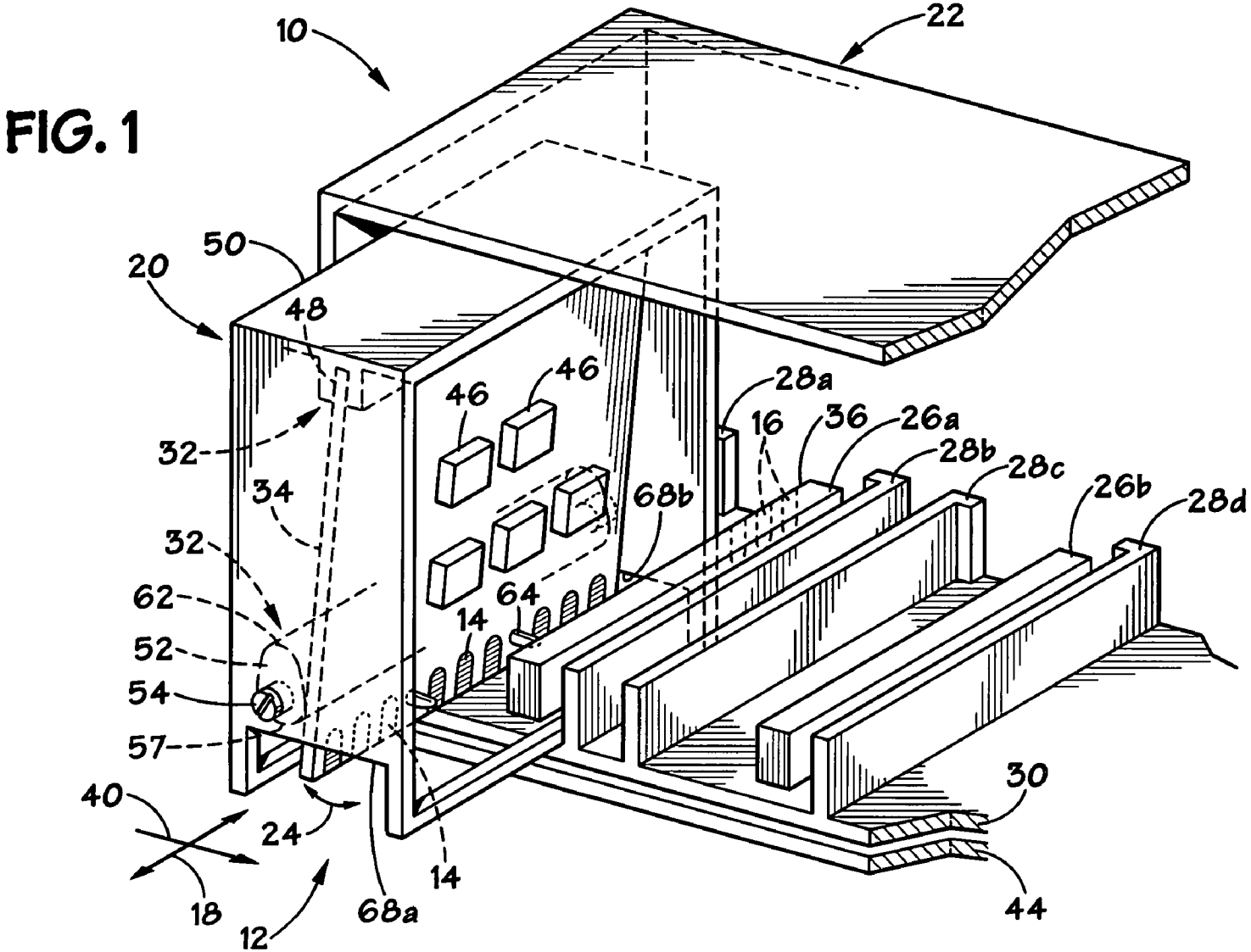
FIG. 1 is a diagram illustrating a partial perspective view of an exemplary computer system comprising a connection system in accordance with embodiments of the present invention.
Figure 2:
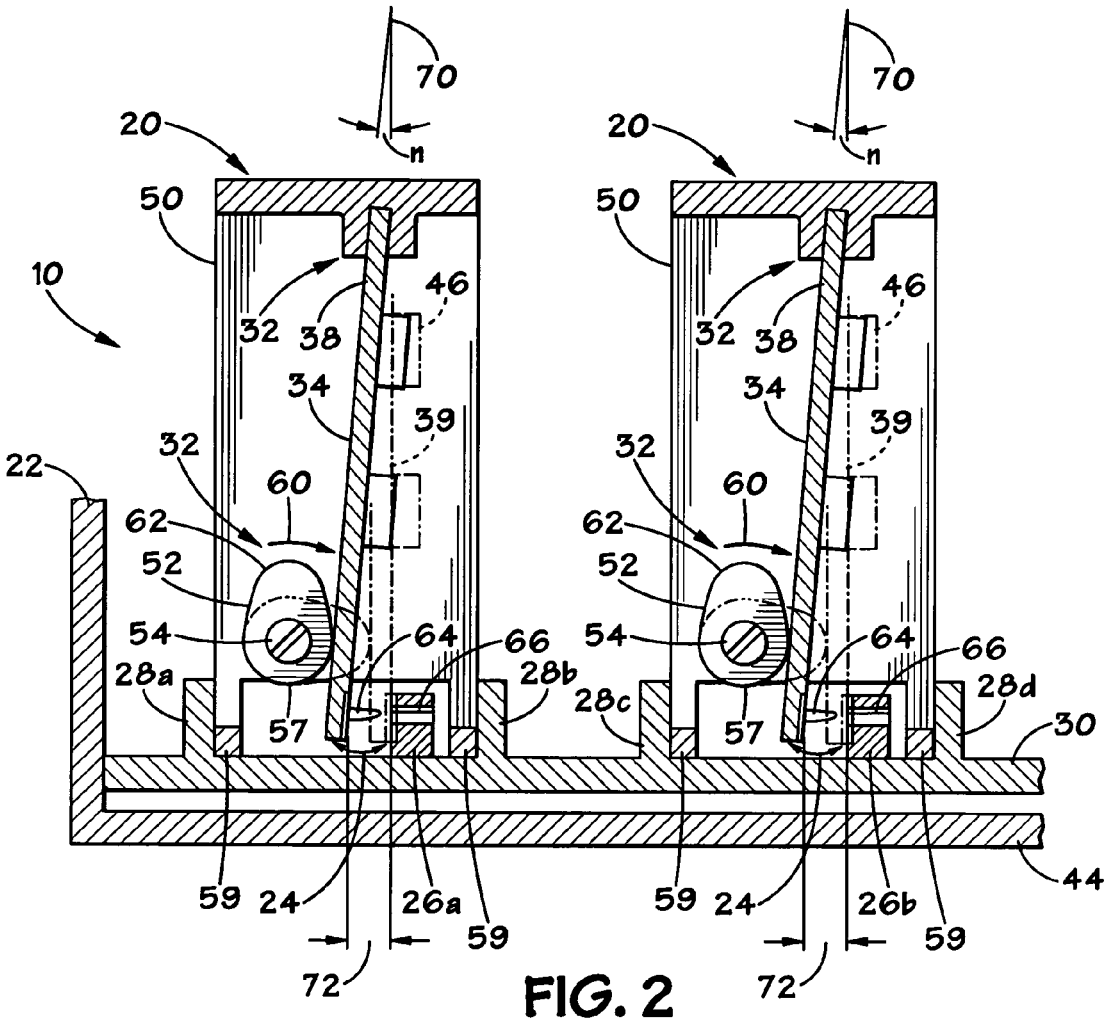
FIG. 2 is a diagram illustrating a partial cross-sectional view of the computer system comprising the connection system in accordance with embodiments of the present invention.

Turning now to the drawings, FIG. 1 is a diagram illustrating an exemplary computer system 10, such as a rack server, comprising a connection system 12 in accordance with embodiments of the present invention. As discussed in further detail below, the connection system 12 engages and disengages electrical contacts 14 and 16 positioned along a path or direction 18 of insertion or removal of a device 20 into and out of a primary enclosure or chassis 22 by biasing (e.g. pivoting, rotating, or flexing) a portion of the device 20, such that the electrical contacts 14 of the device 20 move along a curved path 24 between an offset position 38 and an engaged position 39 (as shown in FIG. 2) relative to the electrical contacts 16 disposed on an underplane 30 of the chassis 22. The illustrated connection system 12 comprises one or more electronic connectors 26*a* and 26*b* and one or more guide rails 28*a*, 28*b*, 28*c*, and 28*d* disposed on the underplane 30. The illustrated connection system 12 also includes a pivoting mechanism 32 to bias a circuit board 34 having a first row of the electrical contacts, pads, or wires 14 inwardly against the electrical connector 26*a*, such that the contacts 14 engage a second row of the electrical contacts, pads, or wires 16 along a side 36 of the respective electronic connector 26*a*.

More specifically, the device 20 having the circuit board 34 is first installed slidingly into the chassis 22, such that the contacts 14 and 16 pass by one another at a desired offset 72 (shown in FIG. 2) in a substantially parallel orientation or direction 18. Once installed so that the contacts 14 and 16 are positioned generally opposite from one another (see FIG. 3), the pivoting mechanism 32 is engaged to bias the circuit board 34 in a generally perpendicular orientation or direction 40 relative to the parallel orientation or direction 18 of installation. As the circuit board 34 pivots, rotates, or flexes toward the electronic connector 26*a*, the offset 72 (see FIG. 2) reduces until the contacts 14 and 16 engage one another to make electrical contact (see FIGS. 2-4). The pivot mechanism 32 also may continue to pivot, rotate, or flex the circuit board 34 to provide a desired load between the contacts 14 and 16. The connection system 12 also functions to disengage the contacts 14 and 16 by pivoting, rotating, or flexing the circuit board 34 in the reverse direction, such that the contacts 14 of the circuit board 34 travel along the curved path 24 away from the contacts 16 to the offset position 38 (see FIG. 2). At this offset position 38, the connection system 12 facilitates withdrawal of the device 20 in the orientation or direction 18 out of the chassis 22.

Embodiments of the connection system 12 may be employed in a variety of suitable computer systems 10, such as a portable computer, a desktop computer, a tower computer, a stand alone server, a rack server, and so forth. For example, the connection system 12 may be employed within a variety of portable or stationary computers manufactured by Hewlett Packard Company of Palo Alto, Calif. For example, exemplary embodiments of the connection system 12 may be employed in a Hewlett Packard's (HP's) ProLiant BL p-Class blade server in conjunction with modified versions of a HP's ProLiant BL20p server blade, HP's ProLiant BL30p server blade, or HP's ProLiant BL40p server blade.

In the illustrated embodiment, the pivot mechanism 32 comprises a cam 52, a cam rotation mechanism 54, and a board attachment rail 48. The cam 52 may comprise a variety of geometries or curved surfaces offcenter from the rotation mechanism 54, such that the cam 52 has a gradually increasing or decreasing radius around the circumference of the cam 52 (e.g., an oblong shape). The oblong shape of the cam 52 enables the cam 52 to bias the circuit board 34 from the offset position 38 to the engaged position 39 when the cam 52 is activated (e.g., rotated in a clockwise direction 60), as shown in FIG. 2. In an alternate embodiment, the cam 52 comprises an oblong-shaped cam that is configured to press against both the circuit board 34 and an outer wall of a device enclosure 50 of the device 20 when the circuit board 34 is in the engaged position 39. In this embodiment, the cam 52 may be configured such that a bottom portion 57 of the cam 52 presses against the outer wall of the device enclosure 50 when the circuit board 34 is in the engaged position 39. This embodiment distributes a portion of the force from the cam 52 onto the outer wall of the device enclosure 50 thereby reducing the stress on the device enclosure 50 in the region where the cam rotation mechanism 54 (described below) is connected to the enclosure 50. Further, while the cam 52 is depicted in FIGS. 1-4 as an oblong camming mechanism, those skilled in the art will appreciate that any mechanical means suitable to pivot, rotate, or flex the circuit board 34 may be employed in alternate embodiments. For example, an alternate embodiment is depicted and described below with reference to FIGS. 5-7.

The cam rotation mechanism 54 may comprise a variety of mechanisms suitable for activating (e.g., rotating or actuating) the cam 52. In one embodiment, the cam rotation mechanism 54 comprises a shaft coupled to the cam 52 and rotatably coupled to the front and back of the enclosure 50 of the device 20. In this embodiment, the device enclosure 50 structurally supports the forces between the cam 52 and the circuit board 56 is in the engaged position 39. In the illustrated embodiment, the edge of the cam rotation mechanism 54 may include a #8 slot screw to cooperate with a screw driver (e.g. a flat head screw driver). In another embodiment, the cam rotation mechanism 54 may comprise a handle, lever, an enlarged disk, or other leveraging member suitable for manual rotation. In yet another embodiment, the pivot mechanism 54 may include an electric motor configured to rotate the cam 52.

As illustrated in FIG. 1, the pivot mechanism 32 may also comprise a board attachment rail 48. In one embodiment, the circuit board 34 may be firmly fixed to the board attachment rail 48. Alternatively, the board attachment rail 48 is configured to attach the circuit board 34 to the device enclosure 50, while still allowing a degree of flexibility or rotation between the circuit board 34 and the device enclosure 50. In another embodiment, the board attachment rail 48 may comprise some form of hinge or pivot joint. In still alternate embodiments, other suitable forms of the board attachment rails 48 may be employed. In various embodiments, the board attachment rail 48 can be formed of a variety of materials, geometries, and structures depending on the desired rigidity, flexibility, or rotatability. For example, the rail 48 may comprise plastic, metal, rubber, or combinations thereof.

Turning next to the operation of the pivot mechanism 32, FIG. 2 is a diagram illustrating a partial cross-sectional view of the computer system 10 comprising the connection system 12 in accordance with embodiments of the present invention. For simplicity, like reference numerals have been used to designate those features previously described in reference to FIG. 1. First, the cam 52 may be activated by a variety of manual and/or automated actuators. In the illustrated embodiment, the cam 52 is activated by rotating the cam rotation mechanism 54 in the clockwise direction 60. This rotation, in turn, causes a top portion 62 of the cam 52 to rotate in the clockwise direction 60 and to press against the circuit board 34. Because the circuit board 34 is attached to the device enclosure 50 by the board attachment rail 48, the top portion 62 of the cam 52 causes the circuit board 34 to pivot, rotate, or flex relative to the board attachment rail 48 along the curved path 24 until the circuit board 34 makes contact with the board connector 26*a* and 26*b*. In one embodiment, the total movement of the circuit board 34 at the point furthest from the board attachment rail 48 (i.e., the offset 72) is at on the order of one millimeter. In alternate embodiments, the circuit board 34 may move a lesser or greater distance as long as an angle of the deflection n, indicated by the reference numeral 70 in FIG. 2, for the circuit board 34 remains relatively small, such that the circuit board 34 does not become damaged if the circuit board 34 is flexed or pivoted. Furthermore, in one embodiment, the pivoting mechanism 32 may also comprise some form of locking mechanism (not shown) to lock the rotating arm in place once the circuit board 34 is pivoted, flexed, or rotated into the engaged position 39.

Turning next to the underplane 30, the board connectors 26*a* and 26*b* may be any type of board connector suitable to mate with the circuit board 34. As described above, the illustrated board connectors 26*a* and 26*b* each comprise a series or row of the electrical contacts 16 that are configured to align and connect with a corresponding series or row of electrical contacts 14 on the circuit board 34. In one embodiment, the board connectors 26*a* and 26*b* may comprise one half of a peripheral component interconnect ("PCI") express connector. Those skilled in the art will appreciate that the board connector 26*a* and 26*b* are relatively inexpensive compared to the cost of the conventional high density connectors described above.

In one embodiment, the face or side 36 of each board connector 26*a* and 26*b* is oriented at a 90 degree angle relative to the underplane 30 and/or a bottom 44 of the chassis 22. In another embodiment, the face or side 36 of each board connector 26*a* and 26*b* is oriented at an acute angle (i.e., 90-n) relative to the underplane 30 or the bottom 44, such that the electrical contacts 14 and 16 mate at approximately the same angle (e.g., parallel to one another). For example, if the circuit board 34 is disposed at a 90-n degree angle relative to the underplane 30 during the insertion and removal in the direction 18, then the face or side 36 of the board connector 26*a* and 26*b* may be oriented at 90 degrees to permit the circuit board 34 to mate with the board connector 26*a* and 26*b* when the circuit board 34 is pivoted, flexed, or rotated from the offset position 38 (see FIG. 2) to the engaged position 39 (see FIGS. 2-4). The angle 90-n is selected to ensure that the circuit board 34 and the board connector do not collide during the insertion and removal of the device 20. As described above, the angle n (i.e., reference numeral 70 in FIG. 2) is selected such that the pivoting, flexing, or rotating of the circuit board 34 across the angle n will not overly flex or damage the circuit board 34. Alternatively, the side 36 of the connectors 26*a* and 26*b* may be oriented at an acute angle of 90-n relative to the underplane 30, whereas the circuit board 34 is oriented at 90 degrees during insertion and removal in the direction 18. Upon rotating, pivoting, or flexing the circuit board 34, the electrical contacts 14 and 16 engage one another along a plane that is oriented at the angle 90-n relative to the underplane 30.

The board connectors 26*a* and 26*b* may also comprise an alignment pin hole 66 (shown in FIGS. 2-4) to facilitate proper alignment of the electrical contacts 14 and 16. In one embodiment, the alignment pin hole 66 is configured to mate with an alignment pin 64 on the circuit board 34. The alignment pin hole will be discussed further below in relation to the alignment pin 64.

As stated above, the underplane 30 may also comprise the guide rails 28*a*, 28*b*, 28*c*, and 28*d* to facilitate proper alignment of the circuit board 34 and the board connector 26*a* and 26*b*. Specifically, the guide rails 28*a*, 28*b*, 28*c*, and 28*d* may define an area on the underplane 30 to accommodate the device 20. The device 20 may be slid into this area between the guide rails 28*a* and 28*b* or 28*c* and 28*d* to begin the mating process between the underplane 30 and the device 20. In one embodiment shown in FIG. 1, the guide rails 28*a*, 28*b*, 28*c*, and 28*d* may comprise a backstop to prevent the device 20 from sliding all the way through the computer system 10 and to facilitate proper alignment of the device 20 within the chassis 22 (i.e., proper alignment of the electrical contacts 14 and 16). In alternate embodiments, these backstops are removed, replaced, or augmented with other orientation mechanisms, such as the alignment pin 64 and alignment pin hole 66, to ensure that the electrical contacts 14 and 16 are positioned opposite one another. In one embodiment, the guide rails 28*a*, 28*b*, 28*c*, and 28*d* may comprise u-shaped plastic guide rails that allow the device 20 to slide into and out of the computer system 10 without contacting the board connector 26*a* and 26*b*. These u-shaped plastic rails may also reduce the possibility that the device 20 or the underplane 30 will be damaged by the insertion or removal of the device 20. In another embodiment, the device 20 may comprise a protective rail 59 (shown in FIG. 2) on the base of the device enclosure 50 to protect the underplane 30 and the device enclosure 50 from insertion-related damage.

Moving next to the device 20, certain embodiments include the device enclosure 50 to enclose the electrical components of the device 20. The device enclosure 50 may be constructed from a number of suitable materials, such as metal, plastic, and so-forth, as is known to those skilled in the art. For example embodiments of the device enclosure 50 may comprise materials durable enough to handle repeated action by the cam 52, as described above. In one embodiment, the device enclosure 50 comprises a metal enclosure, similar to Hewlett Packard's ProLiant BL20p server blades. However, unlike conventional blades, the device enclosure 50 is constructed with cut-out regions 68*a* and 68*b*, as illustrated in FIGS. 1 and 2. The illustrated device enclosure 50 also includes cut-out regions 68*a* and 68*b* to permit the device 20 to slide into and out of the computer system 10 without making contact with board connectors 26*a* and 26*b*. Those skilled in the art will appreciate the dimensions of the cut-out regions 68*a* and 68*b* will depend on the height and width of the board connector 26*a* and 26*b* (i.e., the cut-out regions 68*a* and 68*b* should be at least large enough fit around the board connectors 26*a* and 26*b*). In alternate embodiments, the device enclosure 50 comprises only a single cut-region 68*a* or 68*b*. In still other embodiments, the cut-out regions 68*a* and 68*b* may be absent entirely and the device 20 may be either lowered or otherwise inserted into the computer system 10 instead of being slid into the computer system 10.

Referring now generally to the circuit board 34, certain embodiments of the circuit board 34 may be any suitable type of printed circuit board (PCB) or printed wiring board (PWB). In one embodiment, the circuit board 34 comprises one or more integrated circuits 46, such as a processor or memory circuits, which may be configured for a particular function or application. For example, an embodiment of the circuit board 34 comprises a blade server circuit board.

The illustrated circuit board 34 also comprises the alignment pin 64 to facilitate proper alignment of the circuit board 34 and the board connector 26*a* and 26*b*. The surface of the alignment pin 64 closest to the circuit board 34 may be at a 90 degree angle or an acute angle 90-n relative to the circuit board 34, as was discussed above. In addition, the alignment pin 64 may be angled, tapered, or rounded as illustrated in FIG. 2 to help guide the alignment pin 64 into the alignment pinhole 66 on the board connector 26*a* and 26*b*. In certain embodiments, the surface of the alignment pin 64 furthest away from the board attachment rail 48 may be contoured to correspond to the curved path 24. In one embodiment, the alignment pin 64 may be configured such that there is a one millimeter gap between the alignment pin 64 and the board connector 26*a* and 26*b* when the circuit board 34 is in the offset position 38. Those skilled in the art will appreciate that a single alignment pin 64 and alignment pin hole 66 are described for illustrative purposes only. In alternate embodiments, there may be more than one alignment pin 64 and multiple corresponding alignment pin holes 66.

In operation, as shown in FIG. 2, when the cam 52 rotates in direction 60, the circuit board 34 pivots, rotates, or flexes in response to the movement of the cam 52, as described above. As this generally non-linear motion occurs, the circuit board 34 travels along the curved path 24 and eventually make contact with the board connector 26*a* and 26*b*. As the circuit board 34 rotates through the curved path 24, the electrical contacts 16 within the board connector 26*a* and 26*b* may slightly scrape along the surfaces of their respective electrical contacts 14 on the circuit board 34. This scraping, which is known to those skilled in the art as a wiping action, may remove impurities or oxidation from the surface of the electrical contacts 14 and improve the quality of the connection between the circuit board 34 and the board connector 26*a* and 26*b*. Those skilled in the art will appreciate that, in alternate embodiments, the electrical contacts 14 may be oriented to face the outer wall of device enclosure 50. In these embodiments, the locations of the cam 52 and the board connector 26*a* and 26*b* may be juxtaposed and the cam 52 may rotate in a counter-clockwise direction.

Figure 3:
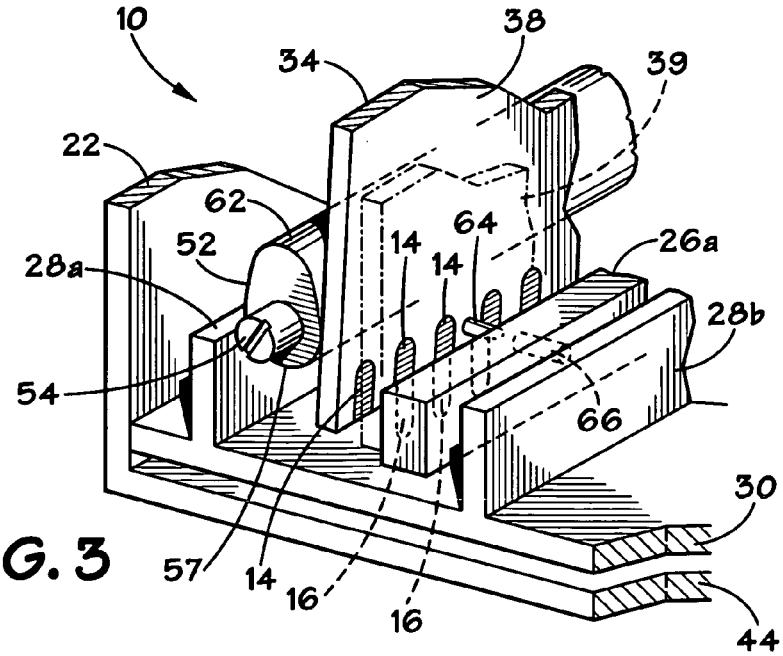
FIG. 3 is a diagram illustrating an partial perspective view of the computer system of FIG. 2 in accordance with embodiments of the present invention.

Further, as the circuit board 34 travels along the curved path 24, the alignment pin 64, if present, will mate with the alignment pin hole 66, as shown in FIGS. 2 and 3. If the alignment pin 64 is not properly aligned (i.e., the circuit board 34 is not properly aligned with the board connector 26*a* and 26*b*), the alignment pin 64 will make contact with the board connector 26*a* and 26*b* in a location other than the alignment pin hole 66. If this occurs, the alignment pin 64 serves as a standoff between the circuit board 34 and the board connector 26*a* and 26*b* preventing the contacts 14 and 16 from connecting at the improper alignment. In this way, the alignment pin 64 and the alignment pin hole 66 serve to ensure that the circuit board 34 is properly aligned to the board connector 26*a* and 26*b*. In one embodiment, the alignment pin hole 66 is contoured (e.g. sloped) to guide the alignment pin 64 into the mated position. This feature is particularly advantageous if the circuit board 34 is slightly misaligned. In this embodiment, as the alignment pin 64 is guided into the alignment pin hole 66, the device 20 (and thus the circuit board 34) may shift either forward or backwards in the direction 18 to correct any slight misalignment between the circuit board 34 and the board connector 26*a* and 26*b*.

Turning next to FIG. 3, a diagram of a partial perspective view of the computer system 10 of FIG. 2 in accordance with embodiments of the present invention is illustrated. For simplicity, like reference numerals have been used to designate those features previously described in reference to FIGS. 1 and 2. As illustrated in FIG. 3, the cam 52 extends parallel to the circuit board 34 along the length of the device enclosure 50. In one embodiment, the cam 52 extends along the entire length of the circuit board 34. In alternate embodiments, the cam 52 may only extend for a portion of the length of the circuit board 34 sufficient to pivot, rotate, or flex the circuit board 34 into contact with the board connector 26*a* and 26*b*.

Turning next to FIG. 4, a diagram illustrating a partial cross-sectional view of another exemplary computer system 10 comprising a connection system in accordance with embodiments of the present invention is illustrated. For simplicity, like reference numerals have been used to designate those features previously described in reference to previous figures. The embodiment of the computer system 10 illustrated in FIG. 4 is configured to interface with a dual board device 100. Accordingly, the embodiment of the computer system 10 shown in FIG. 4 comprise an underplane 30 that includes two board connectors 26*a* and 26*b* between a single pair of the guide rails 28*a* and 28*b*. As illustrated, the space between the guide rails 28*a* and 28*b* is greater than the space between the guide rails in the embodiment depicted in FIGS. 1-3. Moreover, the illustrated dual board enclosure 100 comprises two cams 52*a* and 52*b* and two circuit boards 34*a* and 34*b*, each of which is configured to mate with one of the board connectors 26*a* and 26*b* in the manner described above with reference to FIGS. 1-3. As illustrated in FIG. 4, the orientation of the contacts 14 and 16 on each of the circuit boards 34*a* and 34*b* controls the locations of the board connectors 26*a* and 26*b* as well as the direction of rotation of the cams 52*a* and 52*b*. For example, in the embodiment shown in FIG. 4, the cam 52*a* will rotates in the clockwise direction 60 to pivot, flex, or rotate the circuit board 34*a*, whereas the cam 52*b* rotates in a counter-clockwise direction 61 to pivot, flex, or rotate the circuit board 34*b*. In alternate embodiments, the locations of the board connectors 26*a* and 26*b* may differ or the direction of rotation of each of the circuit boards 34*a* and 34*b* may differ. For example, in one embodiment, the cams 52*a* and 52*b* may be located between the circuit boards 34*a* and 34*b*. Accordingly, the board connectors 26*a* and 26*b* may be located outside of the circuit boards 34*a* and 34*b*. In this embodiment, the cams 52*a* and 52*b* may be configured to pivot, rotate, or flex the circuit boards 34*a* and 34*b* outwardly towards to the outer walls of the device enclosure 50 to make contact with the board connectors 26*a* and 26*b*.

FIG. 5 is a diagram illustrating an alternate computer system 10 comprising an alternate connection system in accordance with embodiments of the present invention. For simplicity, like reference numerals have been used to designate those features previously described in reference to FIGS. 1-4. As shown in FIG. 5, this alternate embodiment features a pivoting mechanism 32 that comprises a rotating arm 130 coupled to the underplane 30 in place of the cam 52 coupled to the device enclosure 50, as illustrated in FIGS. 1-4. In one embodiment, the rotating arm 130 may be mounted to the underplane 30 by a retaining bracket 132. As shown in FIG. 5, the retaining bracket 132 couples the rotating arm 130 to the underplane 30 while allowing the rotating arm 130 to rotate in the clockwise direction 60, as illustrated in FIG. 5. An arm rotation mechanism 134, similar to the cam rotation mechanism 54 described above, may be attached to the rotating arm 130 to activate the rotating arm 130. For example, in one embodiment shown in FIG. 5, the arm rotation mechanism 134 is configured to cooperate with a screw driver. In another embodiment (not shown), the arm rotation mechanism may comprise a handle, lever, disk, or leveraging member suitable for manual rotation.

In operation, the arm rotation mechanism 134 may rotate the rotating arm 130 in the clockwise direction 60. Upon rotation, the rotating arm 130 will force the circuit board 34 to pivot, flex, or rotate across the curved path 24 from the offset position 38 to the engaged position 39 in a manner similar to that described above in relation to FIGS. 1-4. In one embodiment, the pivoting mechanism 32 may also comprise some form of locking mechanism (not shown) to lock the rotating arm in place once the circuit board 34 is pivoted, flexed, or rotated into the engaged position 39.

FIG. 6 is a diagram illustrating an exploded perspective view of the alternative computer system 10 of FIG. 5 in accordance with embodiments of the present invention. For simplicity, like reference numerals have been used to designate those features previously described in reference to previous figures. As with the cam 52 described above in regard to FIG. 3, the illustrated rotating arm 130 is oriented parallel to the circuit board 34 along the length of the device enclosure 50. In one embodiment, the rotating arm 130 may extend the entire length of the circuit board 34. In alternate embodiments, the rotating arm 52 may only extend for a portion of the length of the circuit board 56 sufficient to flex or rotate the circuit board 34 into contact with the board connector 26*a, b*. As shown in FIG. 6, the computer system 10 may also comprise multiple retaining brackets 132, as necessary to secure the rotating arm 130 to the underplane 16. Further, the underplane 30 may comprise a recessed portion 136 to facilitate attachment and rotation of the rotating arm 130.

FIG. 7 is a diagram illustrating a partial cross-sectional view of another alternative computer system comprising a connection system in accordance with embodiments of the present invention. For simplicity, like reference numerals have been used to designate those features previously described in reference to FIGS. 1-6. As shown in FIG. 7, the dual board enclosure 150 comprises two circuit boards 34*a* and 34*b* configured to connect with two board connectors 26*a* and 26*b* mounted on the underplane 30. Similar to the embodiment of the computer system 10 depicted in FIG. 4, the embodiment of the computer system 10 illustrated in FIG. 7 is configured to interface with a dual board device 150. As such, the embodiment of the computer system 10 shown in FIG. 7 may comprise an underplane 30 that includes two board connectors 26*a* and 26*b* and two rotating arms 130*a* and 130*b* between a single pair of the guide rails 28*a* and 28*b*. Furthermore, as with the embodiment shown in FIG. 4, the space between the guide rails 28*a* and 28*b* may be greater than the space between the guide rails in the embodiment of the computer system 10 depicted in FIGS. 5 and 6. In alternate embodiments, the locations of the board connectors 26*a* and 26*b* may differ and the direction of rotation of the circuit boards 34*a* and 34*b* may differ. For example, in one embodiment, the rotating arms 130*a* and 130*b* may be located between the circuit boards 34*a* and 34*b*. Accordingly, the board connectors 26*a* and 26*b* may be located outside of the circuit boards 34*a* and 34*b*. In this embodiment, the rotating arms 130*a* and 130*b* may be configured to pivot, rotate, or flex the circuit boards 34*a* and 34*b* outwardly towards to the outer walls of the device enclosure 150 to make contact with the board connectors 26*a* and 26*b*.

Those skilled in the art will appreciate that the embodiments described above are merely exemplary and not intended to be exclusive. Accordingly, numerous alternate embodiments employing the techniques outlined above are possible. For example, in one alternate the device enclosure 50 may be absent and the remaining elements of the device 20 may be mounted to the chassis 22 of the computer system 10. In this embodiment, the circuit board 34 may slide into a board retaining rail 48, mounted directly to upper chassis 22.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A mechanism configured to engage a first circuit board, such that a first electrical connector on the first circuit board moves along a curved path until the first electrical connector makes electrical contact with a second electrical connector coupled to a second circuit board, wherein the first circuit board is coupled to a structure at a distance from the first electrical connector.

2. The mechanism, as set forth in claim 1, wherein the mechanism comprises a cam configured to bias the first circuit board along the curved path.

3. The mechanism, as set forth in claim 1, wherein the mechanism comprises a rotatable member configured to bias the first circuit board along the curved path.

4. The mechanism, as set forth in claim 1, comprising one or more guides configured to guide movement of the first circuit board along the second circuit board in a first direction along which the first and second electrical connectors are generally parallel and offset from one another, wherein the first direction is generally transverse to a second direction along the curved path.

5. A computer system comprising:

a first circuit board comprising a first connector;

a second circuit board disposed at an angle relative to the first circuit board and having a second connector couplable to the first connector, wherein the second circuit board is configured to move in a first direction along the first circuit board to generally align the first and second connectors; and a mechanism configured to engage the second circuit board, such that the second connector moves in a second direction along a curved path between an engaged position coupled to the first connector and a disengaged position offset from the first connector, wherein the first direction is substantially transverse to the second direction along the curved path.

6. The mechanism, as set forth in claim 1, wherein the structure comprises a rail.

7. The mechanism, as set forth in claim 1, wherein the structure comprises a pivot joint.

8. The mechanism, as set forth in claim 1, wherein the curved path has a curvature at least partially based on the distance.

9. The computer system, as set forth in claim 5, wherein the first direction is generally parallel to the first circuit board, the second circuit board is generally upright relative to the first circuit board, the first and second connectors are separated by the offset during movement of the second circuit board in the first direction, and the mechanism is configured to close the offset in the second direction after movement of the second circuit board in the first direction.

10. The computer system, as set forth in claim 5, wherein the mechanism comprises a camming mechanism.

11. The computer system, as set forth in claim 5, wherein the mechanism comprises a rotatable bar.

12. The computer system, as set forth in claim 5, comprising one or more rails configured to guide movement of the second circuit board relative to the first circuit board in the first direction.

13. The computer system, as set forth in claim 12, comprising one or more alignment structures configured to align electrical contacts of the first and second connectors in positions opposite from one another in the second direction.

14. The computer system, as set forth in claim 5, wherein the first circuit board is coupled to a chassis of the computer system.

15. The computer system, as set forth in claim 14, wherein the second circuit board is coupled to an enclosure configured to slide into the chassis in the first direction.

16. The computer system, as set forth in claim 5, wherein the second circuit board is flexible and the mechanism is configured to flex the second circuit board such that the second connector travels along the curved path.

17. The computer system, as set forth in claim 5, wherein the second circuit board is configured to rotate around a pivot structure such that the second connector rotates along the curved path.

18. A computer system comprising:

a first circuit board comprising a first connector;

a module configured to move along the first circuit board from a first position to a second position, comprising:

a housing;

a second circuit board coupled to the housing, wherein the second circuit board comprises a second connector; and a biasing mechanism coupled to the housing, wherein the biasing mechanism is configured to bias the second circuit board along a curved path to connect the first and second connectors in the second position of the module.

19. The computer system, as set forth in claim 18, wherein the second circuit board is generally upright relative to the first circuit board.

20. The computer system, as set forth in claim 18, wherein the module is configured to move in a first direction along the first circuit board from the first position to the second position, the first and second connectors are generally offset from one another in a second direction generally transverse to the first direction between the first and second positions, and the curved path is oriented generally in the second direction.

21. The computer system, as set forth in claim 18, wherein the biasing mechanism comprises a camming mechanism.

* * * * *